United States Patent [19]

Gaffney

[11] 4,083,599

[45] Apr. 11, 1978

[54] LIFT CHAIR WITH ROCKER AND WHEEL FRAME ATTACHMENTS

[76] Inventor: Edward J. Gaffney, N26 W27293 Highway SS, Pewaukee, Wis. 53072

[21] Appl. No.: 677,597

[22] Filed: Apr. 16, 1976

[51] Int. Cl.[2] ..... A47C 13/00; A47C 1/02

[52] U.S. Cl. ..... 297/131; 248/393; 297/130; 297/329; 297/330; 297/346; 297/347; 297/DIG. 10

[58] Field of Search ..... 5/81 R; 280/30, 43.23, 280/43.24; 297/130-132, 347, 330, DIG. 4, DIG. 10, 329, 346; 248/393

[56] References Cited

U.S. PATENT DOCUMENTS

| | | | |
|---|---|---|---|
| 864,374 | 8/1907 | Honig | 297/131 |
| 2,528,452 | 10/1950 | Riley et al. | 297/130 X |
| 3,023,048 | 2/1962 | Barton | 297/330 |
| 3,091,426 | 5/1963 | Bogart | 297/330 UX |
| 3,138,402 | 6/1964 | Heyl et al. | 297/330 X |
| 3,378,276 | 4/1968 | Fulmer | 280/43.23 |

*Primary Examiner*—James C. Mitchell
*Attorney, Agent, or Firm*—Joseph P. House, Jr.

[57] ABSTRACT

A lift chair has a lift base, a seat, and an extensible and retractable power-actuated ram connected between the lift base and seat to selectively raise and lower the seat. One or another accessory base provided with accessories such as a rocker or wheel assembly is also connected to the seat and is positioned to contact the floor before the ram is fully retracted so that the full retraction of the ram lifts the lift base off the floor and transfers the entire weight of the chair to the accessory base. When the ram is extended, the initial extension of the ram reseats the lift base on the floor and lifts the accessory base off the floor, thus transferring the weight of the chair from the accessory base back to the lift base, which supports and stabilizes the chair during the lifting thereof and until the ram is fully retracted again.

6 Claims, 9 Drawing Figures

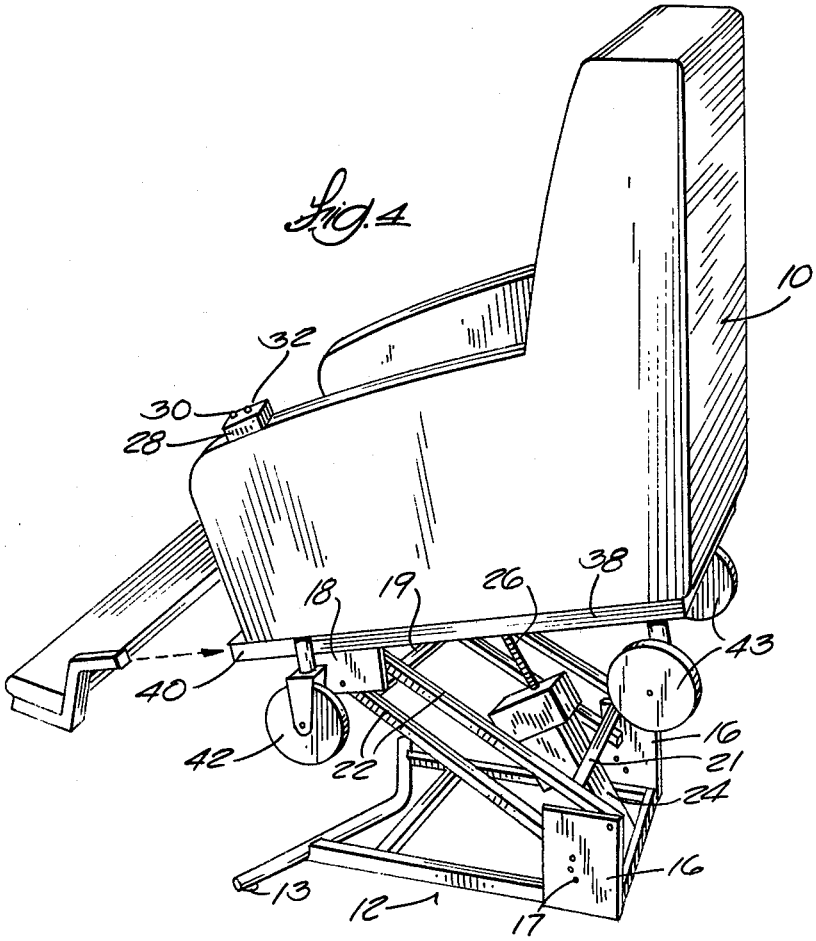
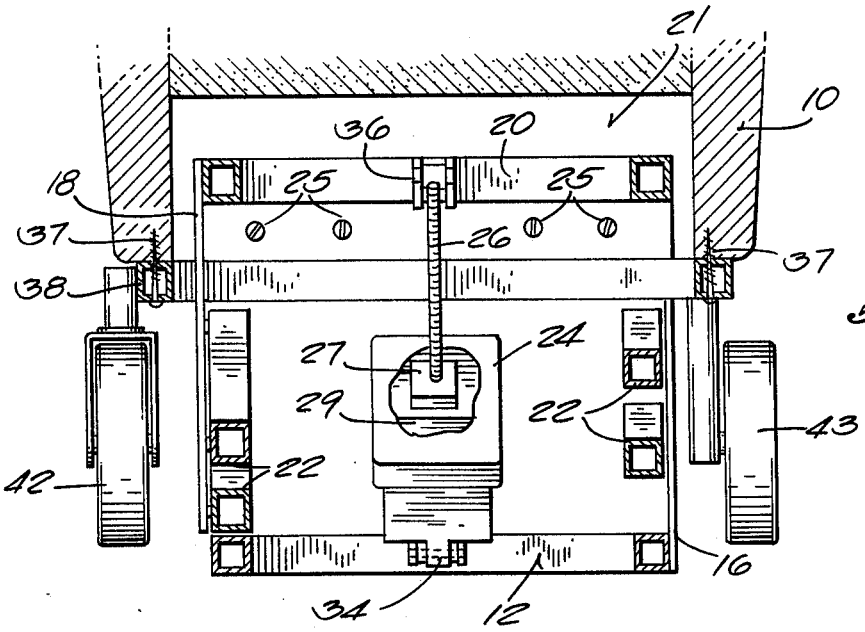
Fig. 6

LIFT CHAIR WITH ROCKER AND WHEEL FRAME ATTACHMENTS

BACKGROUND OF THE INVENTION

This invention relates to power lift chairs in which a seat is selectively raised by a power-actuated ram to assist the occupant in leaving the chair. In the past, such power lift chairs have had a stationary base. It is an object of this invention to provide such a lift chair with accessories, such as a wheeled base or rocker base, to increase the utility of the chair, without adversely affecting the use of the lift feature of the chair.

SUMMARY OF THE INVENTION

In accordance with this invention, the foregoing object is achieved by connecting one or another of various accessory bases to a power lift chair. The accessory base can have various accessories incorporated therein, for example, a rocker or wheels. The accessory base is positioned to contact and seat upon the floor before the power ram is fully retracted so that full retraction of the ram lifts the lift base off the floor and transfers the entire weight of the chair to the accessory base. When the seat is lifted by the power ram, the initial extension of the ram lifts the accessory base off the floor and transfers the weight of the chair from the accessory base back to the lift base, thereby providing a stationary and firm base for the elevated chair. Thus, a wheeled base or a rocker base or the like is employed in such manner as to avoid introducing any instability into the chair during the critical time when the chair seat is being elevated to assist the occupant in leaving the chair.

Other objects, features and advantages of the invention will appear from the disclosure hereof.

DESCRIPTION OF THE DRAWINGS

FIG. 4 is a perspective view of the power lift chair of FIGS. 1–3 in its final lift stage.

FIG. 6 is a cross sectional view taken on the line 6—6 of FIG. 5.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
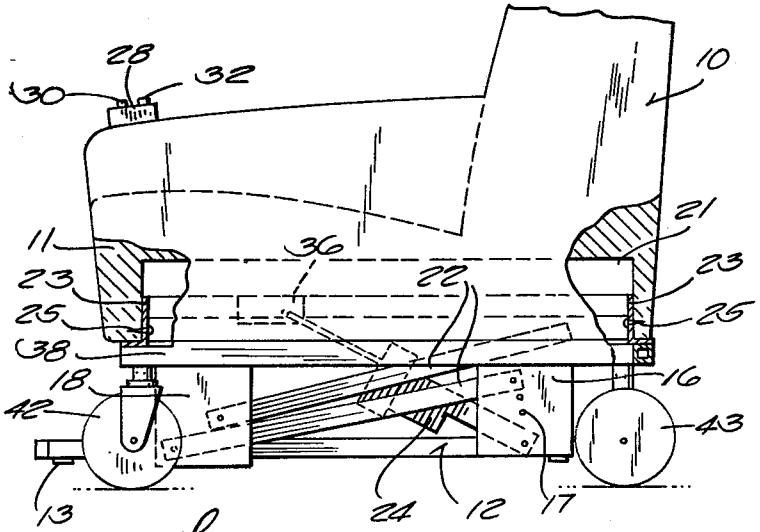
FIG. 1 is a fragmentary side view of a power lift chair having an accessory base with wheels and a lift base, showing the chair in its fully lowered condition in which the weight of the chair is carried by the wheeled accessory base and can readily be moved on its wheels.
Figure 3:
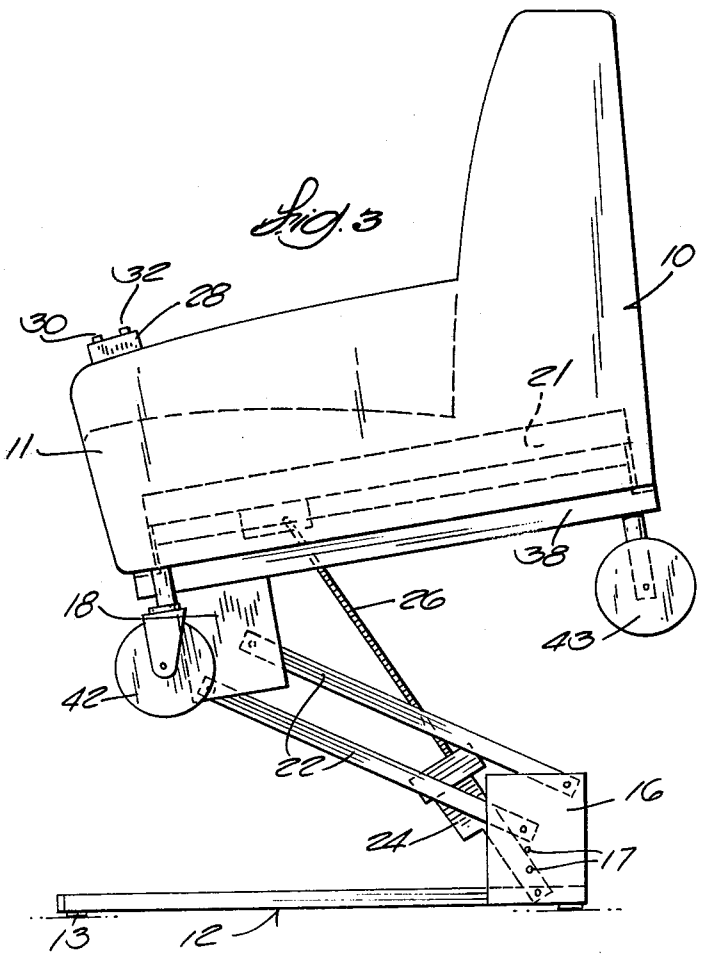
FIG. 3 is a side view similar to FIGS. 1 and 2 and shows the power lift chair of FIGS. 1 and 2 in its final lift stage in which the chair is fully raised.
Figure 5:
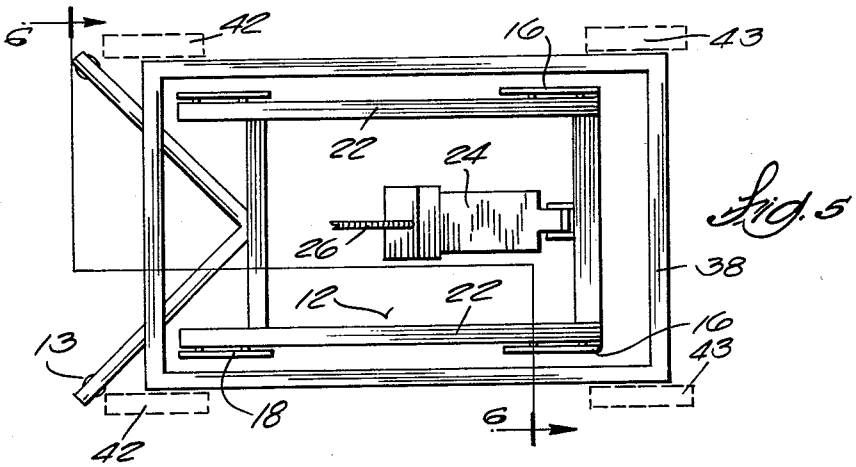
FIG. 5 is a longitudinal sectional view taken on the line 5—5 of FIG. 2.

Referring to FIGS. 1–6, a wood frame chair 10 having a seat portion 11 is connected to a lift base 12 (FIG. 4) by means of double sets of non-parallelogram linkage arms 22. The lift base 12 comprises a rectangular framework which is adapted to seat flat on the floor to provide a broad, sturdy base for the chair. It is desirably provided with leveling pads 13. Mechanism is provided to adjustably support the seat on the lift base 12. This mechanism includes linkage arms 22 which are pivotally connected at their base ends to upright support plates 16 connected to opposite rear corners of the base 12. Linkage arms 22 are pivotally connected at their seat ends to the seat on paired support plates 18 which are attached to and depend from opposite front corners of a rectangular box section metal chair frame 20 (FIG. 5). Frame 20 is received within a hollow recess 21 formed at the bottom of the chair 10. Frame 20 is attached to chair 10 by front and rear angle brackets 23 attached to front and rear wood frame portions of the chair by any suitable fasteners, such as screws 25, as best shown in FIG. 1.

The plates 16 are provided with a series of arcuately disposed pivot bearing openings 17 to which the lowermost linkage arm 22 is selectively pivotally connected to alter the degree of tilt of the seat 11 as the chair 10 is elevated. The upper and lower linkage arms 22 are unequal in length and are arranged in a non-parallelogram configuration, as is well known in the art, to cause chair seat 11 to tilt forward as it is lifted. This assists the occupant in leaving the chair.

Chair 10 is raised and lowered by an extensible and retractable power-actuated ram 24 which can be a hydraulic ram, a pneumatic ram, or an electric motor-driven ram. In the illustrated embodiment, an electric motor-driven ram is shown. The ram comprises a threaded shaft 26 in threaded engagement with a nut 27 driven by motor 29. Motor 29 is supplied with power from a conventional electrical cable (not shown) which is plugged into a conventional wall socket (not shown) and is controlled by a conventional switch box 28 mounted on the arm of chair 10. Switch box 28 has a first momentary contact switch 30 which causes ram 24 to extend and elevate the chair 10 and has a second momentary contact switch 32 which causes ram 24 to retract and lower chair 10.

Power ram 24 is pivotally connected on its lower end to base 12 by pintle 34 (FIG. 6) and is pivotally connected on its upper end (the upper end of shaft 26) to seat frame 20 by pintle 36 (FIG. 6). Accordingly, chair 10 may be elevated or lowered under control by the chair occupant for power-assisted exit from the chair and seating in the chair.

FIGS. 1–6, inclusive, also illustrate one embodiment of chair accessory including a wheeled base by which the chair is utilized as a wheel chair, as well as a lift chair. In this embodiment, an accessory wheeled base 38 is attached by conventional means, such as screws 37, to the wood frame of chair 10. Base 38 typically comprises a rectangular box section metal frame having caster wheels 42 at its front portion and fixed wheels 43 at its rear portion. Alternatively, all wheels can be castered. Base 38 has a larger perimeter than frame 20, and surrounds the lift base 12 and non-parallelogram linkages 14. Base frame 38 is so positioned that wheels 42, 43 will contact the floor before power ram 24 is fully retracted. Accordingly, full retraction of ram 24 causes lift base 12 to raise off the floor, as shown in FIG. 1, so that the full weight of the chair is transferred to wheels 42, 43. Thus, the chair can be easily moved from place to place.

Figure 2:
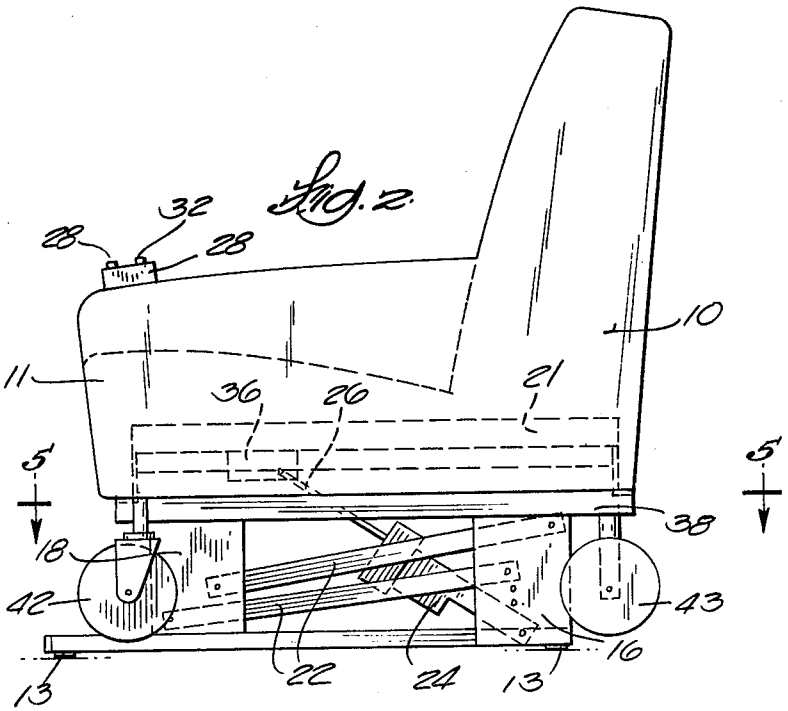
FIG. 2 is a side view similar to FIG. 1 and shows the power lift chair of FIG. 1 in its initial lift stage in which the chair is lifted far enough to transfer the weight of the chair from the wheeled accessory base to the lift base.

When the chair occupant wants to leave the chair and manipulate the controls 28 to extend ram 24, the initial ram extension movement repositions lift base 12 on the floor, and elevates the chair 10 to lift wheels 42, 43 off of the floor, as shown in FIG. 2. This action transfers the weight of the chair back to lift base 12, which provides a stable base or platform when the occupant of the chair subsequently pushes off from the chair.

Figure 9:
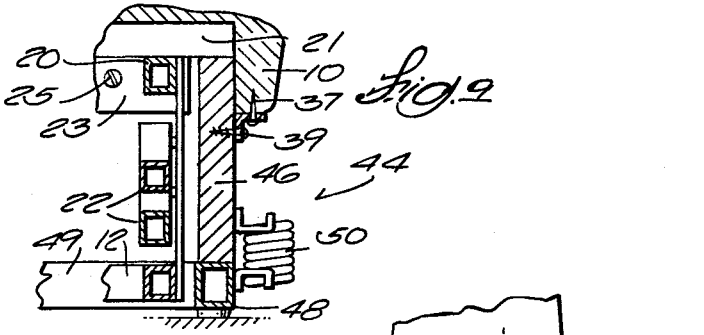
FIG. 9 is a cross section on the line 9—9 of FIG. 8.
Figure 7:
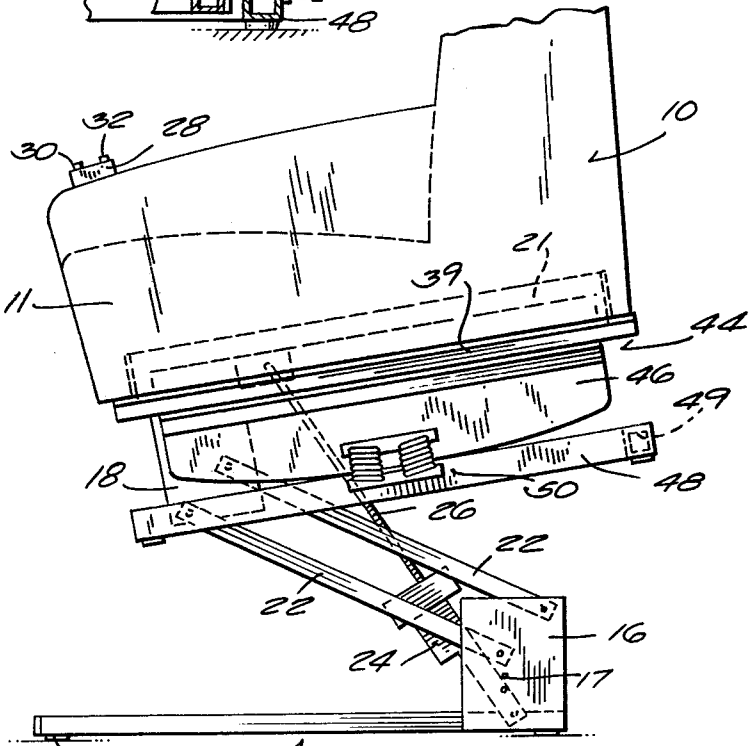
FIG. 7 is a side view of a modified embodiment in which the accessory base has a rocker accessory, the chair being shown in its fully raised position.
Figure 8:
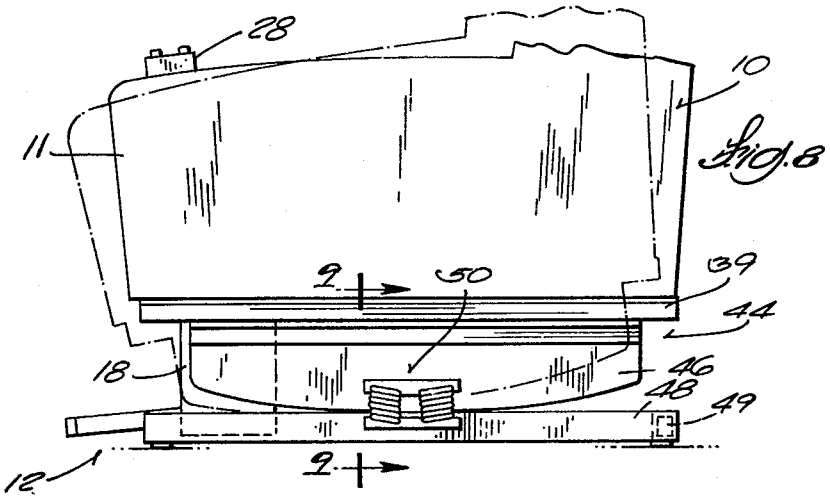
FIG. 8 is a side view of the embodiment of FIG. 7 with the chair lowered to seat the rocker accessory base on the floor. The rocker is illustrated in use.

In another embodiment of accessory base, and in place of wheels 42, 43, a conventional rocker assembly 44, such as shown in FIGS. 7, 8 and 9, can be substituted. Rocker assembly 44 comprises pairs of upper rocker plates 46, which are received partially into pocket 21, as shown in FIG. 9 and are attached by angle brackets 39 and screws 37 to the inner sides of the wooden chair frame 10 which forms pocket 21. The bottom edges of rocker plates 46 are curved. Rocker assembly 44 further comprises pairs of lower rectilinear rocker plates or rails 48 respectively beneath each curved rocker plate 46, and pairs of spring assemblies 50 respectively coupling each pair of rocker plates 46 and 48 together and normally spring biasing the chair 10 to a central position. Rocker assembly 44 is positioned so that the bottom of both linear rocker plates 48 touch the floor before power ram 24 is fully retracted, thus to transfer the full weight of the chair to rectilinear rocker plates 48 when power ram 24 is fully retracted. When the chair is subsequently raised, the weight of the chair transfers back to lift base 12 which stabilizes the chair when the occupant pushes away from the chair.

The aforedescribed structure utilizes the same power ram 24 to lift the chair in a lift mode, and to actuate and deactuate the accessory base in an accessory mode. The utilization of the same or common power ram for both modes results in savings in costs and simplicity of structure.

As in the embodiment of FIGS. 1–6, inclusive, the accessory base of FIGS. 7, 8 and 9 is offset outwardly of the lift base 12, which seats in the chair pocket 21, the rear ends of rocker plate rails 48 being cross connected by stretchers 49.

It is also desirable to provide a cross stretcher 21 cross connecting the lowermost ends of the upper linkage arms 22 and a cross stretcher 19 cross connecting the upper ends of the lower linkage arms 22.

What is claimed is:

1. In a lift chair having a lift base, a seat, mechanism adjustably supporting said seat on said lift base and including an extensible and retractable ram connected between said lift base and said seat to selectively raise and lower said seat and to tilt said seat with respect to said lift base, an accessory base connected to said seat and positioned to contact the floor before said ram is fully retracted so that full retraction of said ram lifts the lift base off the floor, whereby the entire weight of the seat is transferred to said accessory base, less than full retraction of said ram leaving the lift base in contact with the floor to provide a stable base to support the chair during tilting thereof during subsequent extension of the ram.

2. The lift chair of claim 1 wherein said accessory base is offset outwardly of the lift base.

3. The lift chair of claim 1 in which the chair has a downwardly open pocket, said lift base having a frame mounted in said pocket.

4. The lift chair of claim 1 wherein said accessory base includes wheels which engage the floor and permit the chair to be easily moved from place to place.

5. The lift chair of claim 1 wherein said accessory base includes a rocker assembly including a rocker plate fixed to the seat and a rocker rail rockably connected to the rocker plate.

6. The lift chair of claim 1 in which said mechanism further includes non-parallelogram linkage arms which cause the seat to tilt during extension of the ram.

* * * * *